United States Patent [19]

Plewacki

[11] 4,121,392

[45] Oct. 24, 1978

[54] EXTENSIBLE PARTITION

[76] Inventor: Donald Raymond Plewacki, 940 S. Lake Shore Way #A22, Lake Alfred, Fla. 33850

[21] Appl. No.: 845,481

[22] Filed: Oct. 26, 1977

[51] Int. Cl.[2] ..... E04B 1/343

[52] U.S. Cl. ..... 52/64; 49/372; 49/404; 52/63; 52/238; 160/32; 160/37

[58] Field of Search ..... 160/32, 33, 35, 37; 49/404, 372; 52/63, 64, 238, 67

[56] References Cited

U.S. PATENT DOCUMENTS

| | | | |
|---|---|---|---|
| 310,809 | 1/1885 | Fessler | 160/35 X |
| 643,307 | 2/1900 | Schmitt | 160/32 X |
| 1,209,129 | 12/1916 | Coss | 160/32 X |
| 1,804,864 | 5/1931 | Ellis | 160/35 |
| 1,987,488 | 1/1935 | Morelli | 52/64 X |
| 1,994,201 | 3/1935 | Repetto et al. | 160/33 |
| 2,105,095 | 1/1938 | Peterson | 52/63 |
| 3,421,459 | 1/1969 | Sherwood | 52/238 X |
| 3,690,083 | 9/1972 | Miller | 52/238 X |
| 3,817,011 | 6/1974 | Weed | 52/238 |

FOREIGN PATENT DOCUMENTS

| | | | |
|---|---|---|---|
| 643,611 | 8/1962 | Italy | 52/67 |
| 686,795 | 3/1965 | Italy | 49/404 |

*Primary Examiner*—Alfred C. Perham
*Attorney, Agent, or Firm*—Robert D. Farkas

[57] ABSTRACT

An extensible partition utilizes a hollow rectangular elongated partition for erection in a generally vertical plane having spring loaded devices extending upwardly and downwardly from the uppermost and lowermost marginal edges thereof, a slot, extending vertically along a vertical marginal edge of the apparatus, communicates to the hollowed out cavity portion of the panel, so as to provide access throughout the length of the cavity, extending substantially for the entire length of the panel. A plurality of arms are utilized having one end of each pivotably secured to individual helically wound spring members. In one embodiment, the other end of the helical springs are pivotably secured to an accordion-like pleated member which, when not in use, is stored within the cavity. When the accordion, pleated-like member is withdrawn the arms are positioned horizontally such that the springs are likewise positioned horizontally when they are tensioned, keeping tensioning forces on the pleated-like flexible member. A pair of such devices may be utilized having their outermost faces disposed outwardly from a room made up such a pair of devices, and having the walls extending between such panels made up from the accordion-like members. The free end of the accordion members are provided with a plurality of holes adapted to be hooked around pegs extending outwardly from the vertical marginal edge of the panel opposite the slot-like opening. If desired, a picture or other decorative apparatus may be positioned on either rigid surface of the panel. An alternate embodiment utilizes a fabric-like member, replacing the pleated-like member.

8 Claims, 4 Drawing Figures

EXTENSIBLE PARTITION

BACKGROUND OF THE INVENTION

1. The Field of the Invention

This invention relates to partitions, and more particularly to extensible partitions housing flexible extensible members which may be retracted outwardly therefrom when in a used position.

2. Description of the Prior Art

The prior art abounds with partition like devices adapted to be assembled into interlocking wall relationship so as to form walls or compartments of varying sizes. U.S. Pat. No. 3,817,011 issued June 18, 1974 to G. D. Weed, describes a building panel construction consisting of inner and outer panel members secured together in spaced parallel relation in any convenient manner. Spacing studs are secured between and extend along, in recessed position, each pair of corresponding vertical edges of the panel members and define laterally outwardly opening channels extending along the vertical edge portions of each panel construction. A rib or tongue member is supported from and extends along each stud within the corresponding channel and each rib or nesting tongue is spaced from the inner surface of one panel member a distance substantially equal to the thickness of one of the panel members and the spacing between each nesting tongue and the other panel member is substantially equal to the thickness of the nesting tongue. In this manner, adjacent edge portions of adjacent panels may be laterally offset by the thickness of one of the panel members thereof and advanced into position with the edge-defining components of the panel constructions secured together in interdigitated relation. The outer faces of the ribs or nesting tongues are provided with stiff but flexible membranes of somewhat greater width than the nesting membrances themselves and accordingly, these membranes define tight edge-to-surface engaged weather-tight and vapor seal joints between joined marginal edge portions of adjacent panel constructions. The Weed apparatus utilizes rigid panels to make up the wall construction resulting from the assembly together of a plurality of such panels. Accordingly, rooms or walls, constructed of the Weed panel device, must always be dimensioned so as to have a size which is a whole multiple of the panel width.

U.S. Pat. No. 3,690,083 issued on Sept. 12, 1972 to M. A. Miller, describes a panel mounting construction having a horizontal support secured to a building and having a longitudinal track adjustably supporting a plurality of members suspending uprights adapted to be secured to the building and provide spaced anchorage for self-locking securing members inserted through openings in the vertical margins of wall-forming panels. Trim members are anchored to at least the upper horizontal edges of the panels. The Miller apparatus suffers the same basic deficiency as the Weed apparatus, aforementioned.

U.S. Pat. No. 3,421,459 issued Jan. 14, 1969, to J. C. Sherwood also described a panel construction which is convertible so as to form a structural unit for walls and for tables including the attachments utilized in the assembly of such devices. The Sherwood teaching relies upon rigid panels of definite size, thereby precluding the capability of providing walls whose horizontal dimensions are adjustable at the will of the user.

SUMMARY OF THE INVENTION

A primary object of the present invention is to provide a rigid partition having an extensible fabric-like member stored therewithin so as to make up a wall partition of any size greater than the horizontal dimension of the rigid portion thereof alone.

Another object of the present invention is to provide an extensible partition whereby the flexible wall like element, stored therewithin, may be retracted or extended for any desired distance.

Still another object of the present invention is to provide a partition whose flexible extensible element is foldable relative to the plane occupied by the rigid partition, thereby permitting the easy installation of inside or outside corners.

Yet another object of the present invention is to provide a partition utilizing spring operated pins to engage the ceiling or the floor in an easily installed secure manner.

A further object of the present invention is to provide an extensible partition element which is constantly tensioned for retraction, thereby maintaining such flexible extensible element in a taut condition when spanning a horizontal distance, residing in a vertical plane.

Another object of the present invention is to provide an extensible partition whose lateral surfaces may be decorated with pictures or indicia or the like, thereby providing a pleasing finished appearance.

Still another object of the present invention is to provide an extensible partition, totally effective for its purpose, economical to construct, easy to install and light weight.

Yet another object of the present invention is to provide a panel assembly which is continuously extensible in width exceeding the minimum width of the rigid portions thereof.

Heretofore, partitions, of the rigid variety, have been disclosed utilizing a wide variety of fastening devices to interlock such panels either in a straight line wall structure or in walls having elements extending angularly relative to one another. Such devices, though having exterior finished surfaces, are never suitable for constructing walls of varied lengths or more importantly, for constructing walls used to bound an area of any desired size. Furthermore, the prior art devices failed to describe an apparatus whose weight is low and which permits the extensible portions thereof to be totally stored within the rigid portions thereof when such extensible portions are not being employed. The present invention contemplates these problems and solves them by having an extensible flexible member reside within a cavity disposed between a pair of outermost lateral surfaces of a rigid panel device. Because the flexible member is truly flexible, corner arrangements may be achieved at any desired angle without requiring excessive hardware. Furthermore, each rigid panel is provided with a coupling device adapted to couple it to the free edge of the extensible member associated with an adjacent similar type apparatus. Thus, the elongated straight line wall structure may be erected having alternate sections of rigid character interposed between alternate sections of flexible extended panels. In the same fashion, rooms or enclosures, of various types, may be erected by permitting the folding characteristics of the extensible panel to come in to play. Here, an inside or outside corner may be fabricated by utilizing the simple expedient of having the extensible flexible element turn at say, ninety degrees relative to the plane occupied by the rigid panel portion of the present invention. Furthermore, such rigid panel may be installed between a floor and ceiling, utilizing spring loaded pins extending upwardly and downwardly from the uppermost and lowermost marginal edges of the rigid panel.

These objects as well as other objects of the present invention, will become more readily apparent after reading the following description of the accompanying drawings.

DETAILED DESCRIPTION OF THE PREFERRED EMBODIMENT

Figure 1:
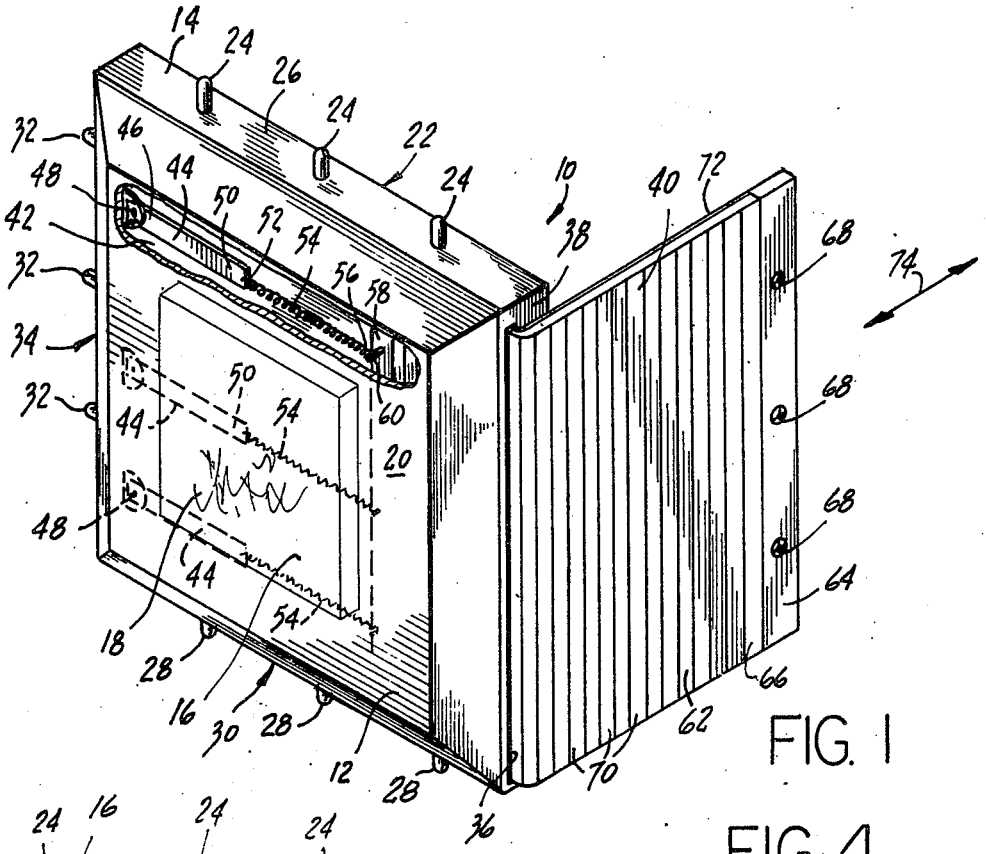
FIG. 1 is a perspective view of the present invention.

The structure and method of fabrication of the present invention is applicable to a pair of flat rigid like panels, fabricated from any suitable material, such as wood, steel, aluminum, or the like. Such rigid panels are disposed in juxtaposed overlying relationship and are provided with spaces disposed in the area adjacent to the uppermost and the lowermost and one vertically disposed marginal edge of each of the panels. These spaces are located adjacent to the marginal edges and spaced in between such panels. The slot, located on the remaining vertical marginal edge area, separating the panels, defines the entrance way to a cavity extending between the interior surfaces of the panels. Three arms, each having a length somewhat less than the width of the panel assembly, have one end thereof pivotably secured to a location intermediate the interior surfaces of the panels and adjacent to the spacer disposed vertically. This is accomplished by pivot rods whose longitudinal axes extend horizontally, passing through one or both panels. Three helically wound spring elements have one end thereof pivotably secured to the free ends of the arms, so as to permit such springs to reside within the cavity. The other ends of such springs are pivotably secured to a flexible member whose height is substantially equal to the opening of the slot. Such flexible member may be fabricated from a plurality of rigid strips each hingeably secured to one another along the marginal edges thereof, in accordion-like fashion, if desired. Alternatively, the flexible sheet may be fabricated from a fabric-like material. Still another embodiment, may utilize a fabric-like sheet, which is elastic in nature. In the accordion pleated-like embodiment, the strip elements may be fabricated from wooden elongated strips, each being secured to a fabric-like base, such as by an adhesive technique. In the elastic fabric-like embodiment, the flexible element may be fabricated from a rubber-like material, or a fabric having a weave suitable for extending the width of the fabric sheet when subjected to tensile forces, such as Osnerberg. The free end of the flexible sheet may be secured to a rigid strip of material, such as aluminum, or wood, such strip having three holes therein disposed in spaced apart relationship along the length thereof. The marginal edge opposite the location of the slot is provided with three rigid pins extending outwardly therefrom, configured to reside within the holes located at the free end of the flexible member. In this fashion, pairs of apparatuses comprising the present invention may be erected in straight wall line relationship having the free end of the flexible elements engaged to the marginal edge disposed running vertically of the adjacent rigid panel of the adjacent present invention. If desired, the flexible element may be bent so as to form an angle relative to the lateral surfaces of the rigid panel portion thereby permitting the apparatus to form an inside or outside corner, at the will of the user. In this fashion, a pair of apparatuses comprising the present invention may be utilized to erect an enclosed area, whose first pair of opposing sides are equal in dimension to the width of the rigid panel portion of the present invention and whose second pair of adjacent flexible sides may be of any desired dimension up to the maximum width of the fully extended flexible portion thereof.

A set of three pins extend upwardly from the uppermost horizontal marginal edge of the apparatus by passing through holes located in the spacers separating the rigid panel portions. The lower most region of such pins is provided with plates fixedly secured thereto extending transverse to the longitudinal axes of the pins. The holes are partially enlarged in the area in which such plates reside. A helical spring is inserted in such enlarged holes causing the free ends of the pins to be urged outwardly of the rigid panel portion of the present invention at all times. The lower most region of the helical spring is secured to the spacers so as to prevent the pins from falling downwardly into the cavity located intermediate the rigid panel portion pair. In like fashion, three additional pins extend downwardly from the lower most horizontal spacer element, for fastening into holes located in the floor. If desired, holes may also be utilized in the ceiling area immediately above the intended location of an erected panel, intended to be positioned residing in a vertical plane.

When the flexible element is intended to be stored totally within the cavity, the rigid arms, utilizing the weight thereof, tend to pivot downwardly relative to the pivot point located at the end thereof adjacent the vertically disposed spacer. The springs, attached to the arms, in like fashion, tend to reside in a vertical direction so as to commit the captured end of the flexible element to move virtually in touching contact with the interior vertical surface of the vertical spacing element. When the flexible element is drawn partially outwardly from the cavity, by passing through the slot, the captured end thereof is moved towards the slot causing a horizontally disposed force to be placed upon the spring and thus, to be placed upon the arm pivotably secured thereto. When the captured end of the flexible element has virtually reached the end of its travel, adjacent to the slot opening of the cavity, a pin, extending outwardly from the flexible panel trailing edge, engages a portion of the wall defining the slot so as to prevent the captured end of the flexible element from being totally withdrawn outwardly from the cavity. In this position, the weight of the arm and the tensioning forces of the spring, both act upon the captured end of the flexible element so as to tension such element at all times when the free end thereof is disposed outwardly of the cavity, regardless of whether such end is disposed in a plane parallel to the plane of the lateral surfaces of the rigid panel or in a plane forming an angle relative to the lateral surfaces of the rigid panel portion of the present invention.

Now referring to the figures, and more particularly to the embodiment illustrated in FIG. 1 showing the present invention 10 shown having a rigid panel 12 on one lateral surface thereof defining a lateral surface of a rigid panel portion 14. Picture 16, carrying indicia 18, may be secured to surface 20 of panel 12, if desired. Other decorative indicia, not shown, may also be employed. Rear most surface 22, shown residing parallel to surface 20, may also be decorated appropriately. Upwardly, vertically directed pins 24 extend outwardly and upwardly from uppermost marginal edge 26. Lower vertically extending pins 28, extend downwardly from lowermost marginal edge 30. Pins 32 extend outwardly, in a horizontal direction, from vertically disposed marginal edge 34. Slot 36 is provided in marginal edge 38, shown extending parallel to marginal edge 34. Flexible element 40 is shown partially withdrawn from cavity 42, shown disposed between surfaces 22 and 20. Ends 44 are depicted pivotably secured at ends 46 thereof to interior surface of cavity 42, utilizing pivot rods 48 therefore. Ends 50 of rods 44, are pivotably secured to ends 52 of elongated helically wound springs 54. Ends 56 of springs 54 are pivotably secured to edge 58 of flexible element 40. Pin 60 is shown extending outwardly from lateral surface 62 comprising an exterior surface of flexible element 40. Rigid strip 64 is connected fixedly to edge 66 of flexible element 40 and is provided having holes 68 therein, suitable for engagement about pins, not shown, dimensioned similarly to pins 32. Slats 70, making up flexible element 40, may be secured to a flexible fabric-like sheet 72 therebehind, utilizing adhesives. If desired, flexible element 40, may be fabricated from a fabric-like material of any conventional construction, or may be fabricated from a fabric whose horizontal dimension, shown extending along the direction of arrows 74, may be adjustable due to the character of the weave comprising such material.

Figure 2:
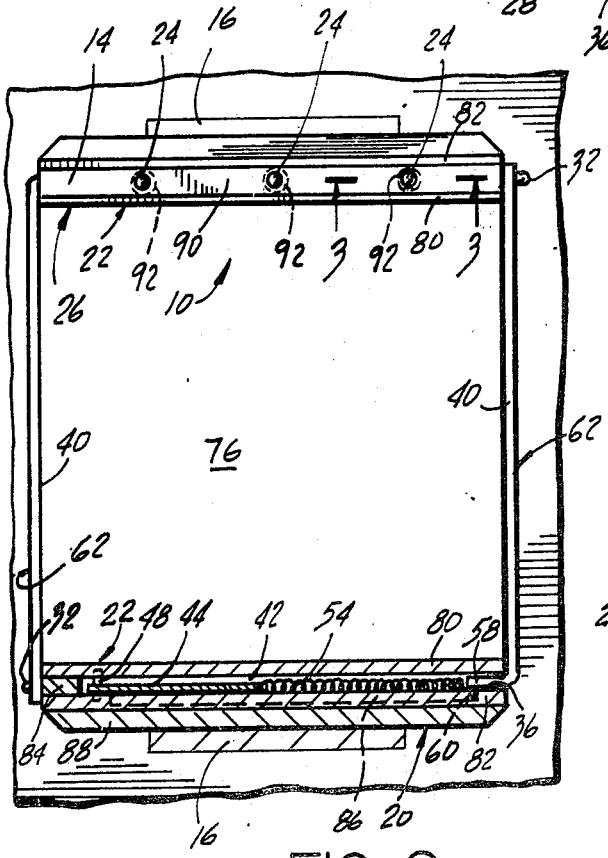
FIG. 2 is a plan view of a pair of devices described by the present invention installed forming a room.

FIG. 2 illustrates present inventions 10, being disposed defining an enclosed area 76. Rigid panel portions 14 are shown disposed parallel to one another while flexible element portions 40 are shown disposed parallel to one another and perpendicularly to innermost surfaces 22. Rigid panels 80 and 82 are shown disposed parallel to one another having cavity 42 located thereinbetween. Vertical spacer strip 84 is shown extending between the innermost surfaces of such cavity-defining panels and is provided having pins 32 extending outwardly from the outermost surface 62 of flexible elements 40. Pivot rod 48 is shown attached to arm 44 having helical spring 54 also attached thereto. Captured end 58 of flexible element 40 is shown having pin 60 extending into groove 86, horizontally disposed in panel 82, thereby preventing end 58 from emerging outwardly from slot 36. Molding portions 88 are disposed over the exterior most surface of panel 82 so as to provide an exterior lateral surface 20 upon which picture 16 is mounted. Uppermost marginal edge 14 is shown carrying upwardly extending pins 24. A spacer strip 90 is shown interposed between rigid sheet-like panels 80 and 82. Such upwardly extending pins pass through holes 92 in spacer strip 90.

Figure 3:
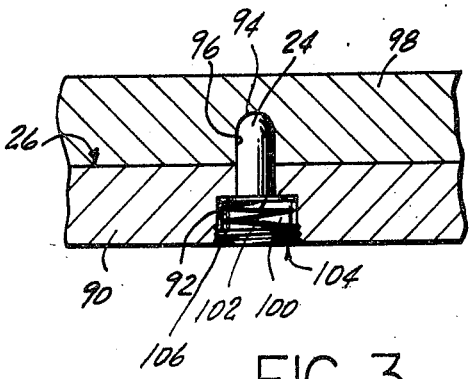
FIG. 3 is the side elevation cross-sectional view of a portion of the present invention shown engaging a portion of a ceiling panel.

FIG. 3 illustrates spacer strip 90 having hole 92 thereof configured to permit upwardly extending pin 24 to pass therethrough so as to pass upwardly and outwardly from uppermost marginal edge 26. End 94, of pin 24, resides in hole 96, located in ceiling panel 98. Hole 100, residing in spacer strip 90, permits the free vertical motion of plate 102, fixedly secured to end 104, of pin 24. Helical spring 106 is caused to reside between plate 102 and cap 104. Cap 104 is threadingly inserted into opening 100, thereby retaining spring 106 within such hole and causing end 94 of pin 24 to be disposed outwardly from uppermost lateral surface 26 with the force created by compressing spring 106. This permits the present invention 10, shown in FIGS. 1 and 2, to be installed securely abutting against ceilings of rooms, not shown. In like fashion, pins 28 shown in FIG. 1, are caused to reside in similar openings located in a floor-like surface, not shown.

Figure 4:
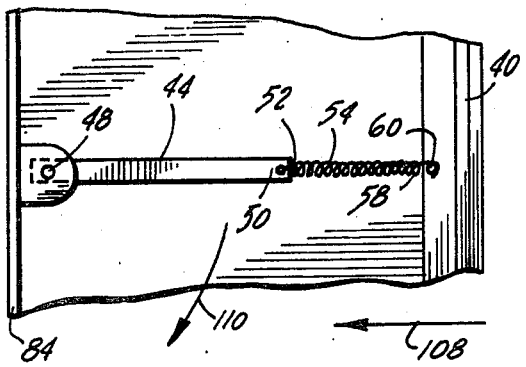
FIG. 4 is a side elevation enlarged partial view of a portion of the present invention.

FIG. 4 illustrates arm 44 utilizing pivot rod 48 to pivotably secure such arm to vertical spacer strip 84, shown in FIG. 2. Spring 54 is illustrated hingeably secured to captured end 58 of flexible element 40. Pin 60 is shown extending outwardly from flexible element 40. When flexible element 40 is permitted to move in the direction of arrow 108, end 50 of arm 44 is permitted to move downwardly in the direction of arrow 110. In like fashion, end 52 of spring 54, is to be permitted to be moved downwardly in a similar direction. This downward motion is continued until such time that arm 44 substantially resides in a vertical direction having spring 54 parallel thereto and adjacent to captured end 58 of flexible member 40. When flexible element 40 is moved in the direction opposite to arrow 108, spring 54 is tensioned, accompanying a force directed in the direction of arrow 108, due to the weight of end 50 of arm 44.

One of the advantages of the present invention is a rigid partition having an extensible fabric-like member stored therewithin so as to make a wall partition of any size greater than the horizontal dimension of the rigid portion thereof alone.

Another advantage of the present invention is an extensible partition whereby the flexible wall like element stored therewithin, may be retracted or extended for any desired distance.

Still another advantage of the present invention is a partition whose flexible extensible element is foldable relative to the plane occupied by the rigid partition, thereby permitting the easy installation of inside or outside corners.

Yet another advantage of the present invention is a partition utilizing spring operated pins to engage the ceiling or the floor in a easily installed secure manner.

A further advantage of the present invention is an extensible partition element which is constantly tensioned for retraction, thereby maintaining such flexible extensible element in a taut condition when spanning a horizontal distance, residing in a vertical plane.

Another advantage of the present invention is an extensible partition whose lateral surfaces may be decorated with pictures or indicia or the like, thereby providing a pleasing finished appearance.

Still another advantage of the present invention is an extensible partition, totally effective for its purpose, economical to construct, easy to install and light weight.

Yet another advantage of the present invention is a panel assembly which is continuously extensible in width exceeding the minimum width of the rigid portions thereof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. An extensible partition comprising an elongated said rigid member, defined by a pair of rigid panels extending parallel to one another and in spaced apart juxtaposed relationship, means to partially bridge said pair of panels together in spacer like fashion about a portion of the marginal edges of said pair of panels, a remaining portion of said marginal edges defining a slot, said slot communicating to a cavity located between interior opposed surfaces of said pair of panels, a flexible element, one end of said flexible element being disposed captured in said cavity and extending through said slot, the other end of said flexible element being disposed outwardly of said cavity, a rigid elongated strip, said rigid elongated strip fixedly secured to said other end of said flexible element, means to gravity load said one end of said flexible sheet causing said one end of said flexible sheet to be urged inwardly into said cavity towards a portion of said portion of said marginal edges, said portion of said portion of said marginal edges being disposed oppositely located to said slot and means to spring bias said one end of said flexible element toward said portion of said portion of said marginal edges when said other end of said flexible element is disposed outwardly from said slot.

2. The apparatus as claimed in claim 1 wherein said means to gravity load comprises at least one arm, one end of said arm being disposed pivotably secured in the interior of said cavity to said portion of said portion of said marginal edges, the other end of said arm being disposed pivotably secured to said one end of said flexible element.

3. The apparatus as claimed in claim 2 wherein said means to spring bias comprises at least one spring, said at least one spring being disposed having a helical shape, one end of said at least one spring being disposed pivotably secured to said other end of said arm, the other end of said at least one spring being disposed pivotably secured to said one end of said flexible element.

4. The apparatus as claimed in claim 1 further comprising at least one pin, said at least one pin passing through a hole disposed in said uppermost marginal edges, at least one biasing spring, one end of said at least one biasing spring, being disposed in touching engagement with one end of said at least one pin, the other end of said at least one biasing spring being disposed in touching engagement with a portion of said pair of panels adjacent said uppermost marginal edges thereof.

5. The apparatus as claimed in claim 1 wherein said elongated rigid strip comprises at least one hole therein, a rigid pin, said rigid pin being disposed extending outwardly from said portion of said portions of said pair of panels, said rigid pin being configured to reside in said at least one hole.

6. The apparatus as claimed in claim 1 further comprising indicia being disposed on at least one lateral exterior surface of one of said pair of panels.

7. The apparatus as claimed in claim 1 further comprising at least another pin, said at least another pin extending downwardly and outwardly from said marginal edges at a location adjacent said portion of said portions of marginal edges thereof, means to bias said at least another pin outwardly from said marginal edges.

8. The apparatus as claimed in claim 1 wherein said flexible element comprises a plurality of elongated rigid bars, said bars extending in parallel spaced apart relationship to one another and being parallel to said other end of said flexible element, a fabric-like sheet, said plurality of bars fixedly secured to said fabric-like sheet in accordion-like fashion, extending parallel to pleat lines disposed parallel to said slot.

* * * * *